US012083586B1

(12) United States Patent
Hattori et al.

(10) Patent No.: US 12,083,586 B1
(45) Date of Patent: Sep. 10, 2024

(54) CASTING DIE AND CASTING METHOD

(71) Applicant: HONDA MOTOR CO., LTD., Tokyo (JP)

(72) Inventors: Masayuki Hattori, Tokyo (JP); Sota Shindo, Tokyo (JP); Kanji Fujii, Tokyo (JP); Tomonori Sakai, Tokyo (JP); Kenichi Fukunaga, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 18/585,474

(22) Filed: Feb. 23, 2024

(30) Foreign Application Priority Data

Mar. 30, 2023 (JP) ..... 2023-054500

(51) Int. Cl.
*B22D 17/22* (2006.01)
*B22D 17/26* (2006.01)

(52) U.S. Cl.
CPC ..... *B22D 17/22* (2013.01); *B22D 17/26* (2013.01)

(58) Field of Classification Search
CPC ..... B22D 17/22; B22D 17/24; B22D 17/26
See application file for complete search history.

(56) References Cited

U.S. PATENT DOCUMENTS 4,592,405 A * 6/1986 Allen ..... B22D 18/02 164/320

FOREIGN PATENT DOCUMENTS

JP H03-009885 Y2 3/1991

* cited by examiner

*Primary Examiner* — Kevin P Kerns
*Assistant Examiner* — Steven S Ha
(74) *Attorney, Agent, or Firm* — Rankin, Hill & Clark LLP

(57) ABSTRACT

A casting die of the present invention includes a stationary die, a movable die, and a sliding die provided to the movable die so as to be insertable and withdrawable in a direction crossing a movement direction of the movable die and configured to form a cavity in collaboration with the stationary die and the movable die. The sliding die includes a slider core that is moved so as to be insertable and withdrawable along the movement direction of the movable die and a stopper that is in contact with the slider core at a die closing position and locks the slider core.

5 Claims, 6 Drawing Sheets

CASTING DIE AND CASTING METHOD

CROSS-REFERENCES TO RELATED APPLICATIONS

The present application relates to and asserts priority from Japanese patent application No. 2023-054500 filed on Mar. 30, 2023, and incorporates the entirety of the contents and subject matter of all the above application herein by reference.

BACKGROUND OF THE INVENTION

1. Field of the Invention

The present invention relates to a casting die and a casting method.

2. Description of the Related Art

Heretofore, there has been known a casting die including a movable core insertable into and withdrawable from a cavity formed between a stationary die and a movable die (for example, see JPH03-009885Y). This casting die includes a first movable core and a second movable core. The first movable core and the second movable core are engaged with each other when a molten metal is poured into the casting die.

In this casting die, the movable cores are prevented from displacing when the molten metal is poured under high pressure, so that the dimensional accuracy of a cast product obtained in the die can be improved.

In the case of the casting die in the related art (for example, JP1991-009885Y), the first movable core and the second movable core need to be engaged with each other and positioned with high accuracy in order to prevent these cores from moving in an application direction of a casting pressure. Therefore, the casting die in the related art has a problem that the freedom in design is restricted.

Moreover, the casting die in the related art has a problem that the maintenance in the case where the first movable core and the second movable core malfunction due to thermal expansion is difficult.

An object of the present invention is to provide a casting die and a casting method that enable higher freedom in design and easier maintenance than in the related art.

SUMMARY OF THE INVENTION

A casting die of the present invention achieving the above object includes: a stationary die; a movable die that is moved to come into and out of contact with the stationary die; and a sliding die provided to the movable die so as to be insertable and withdrawable in a direction crossing a movement direction of the movable die and configured to form a cavity in collaboration with the stationary die and the movable die, wherein the sliding die includes: a slider core that is moved by a first moving mechanism so as to be insertable and withdrawable along the movement direction of the movable die; and a stopper that is moved by a second moving mechanism between a locking position at which the stopper is in contact with the slider core at a die closing position and locks the slider core, and an unlocking position at which the stopper is separated from the slider core and unlocks the slider core.

Further, a casting method of the present invention achieving the above object is a casting method using a casting die including: a stationary die; a movable die that is moved to come into and out of contact with the stationary die; and a sliding die provided to the movable die so as to be insertable and withdrawable in a direction crossing a movement direction of the movable die and configured to form a cavity in collaboration with the stationary die and the movable die, the sliding die including: a slider core that is moved so as to be insertable and withdrawable along the movement direction of the movable die; and a stopper that comes into contact with the slider core at a die closing position and locks the slider core, the method comprising: a moving step of moving the stopper to the slider core; a locking step of positioning and locking the slider core by adjusting a position of the stopper so that a tip of the slider core forms the cavity; a die release agent applying step of applying a die release agent to at least a surface of the stationary die, a surface of the movable die, and a surface of the sliding die, which form the cavity; and a die closing step of placing the sliding die at a sliding die clamping position, and closing the movable die onto the stationary die.

According to the present invention, it is possible to provide a casting die and a casting method that enable higher freedom in design and easier maintenance than in the related art.

DETAILED DESCRIPTION OF THE EMBODIMENTS

Hereinafter, modes (embodiments) for carrying out a casting die and a casting method of the present invention will be described in detail with reference to the drawings when necessary.

Figure 1:
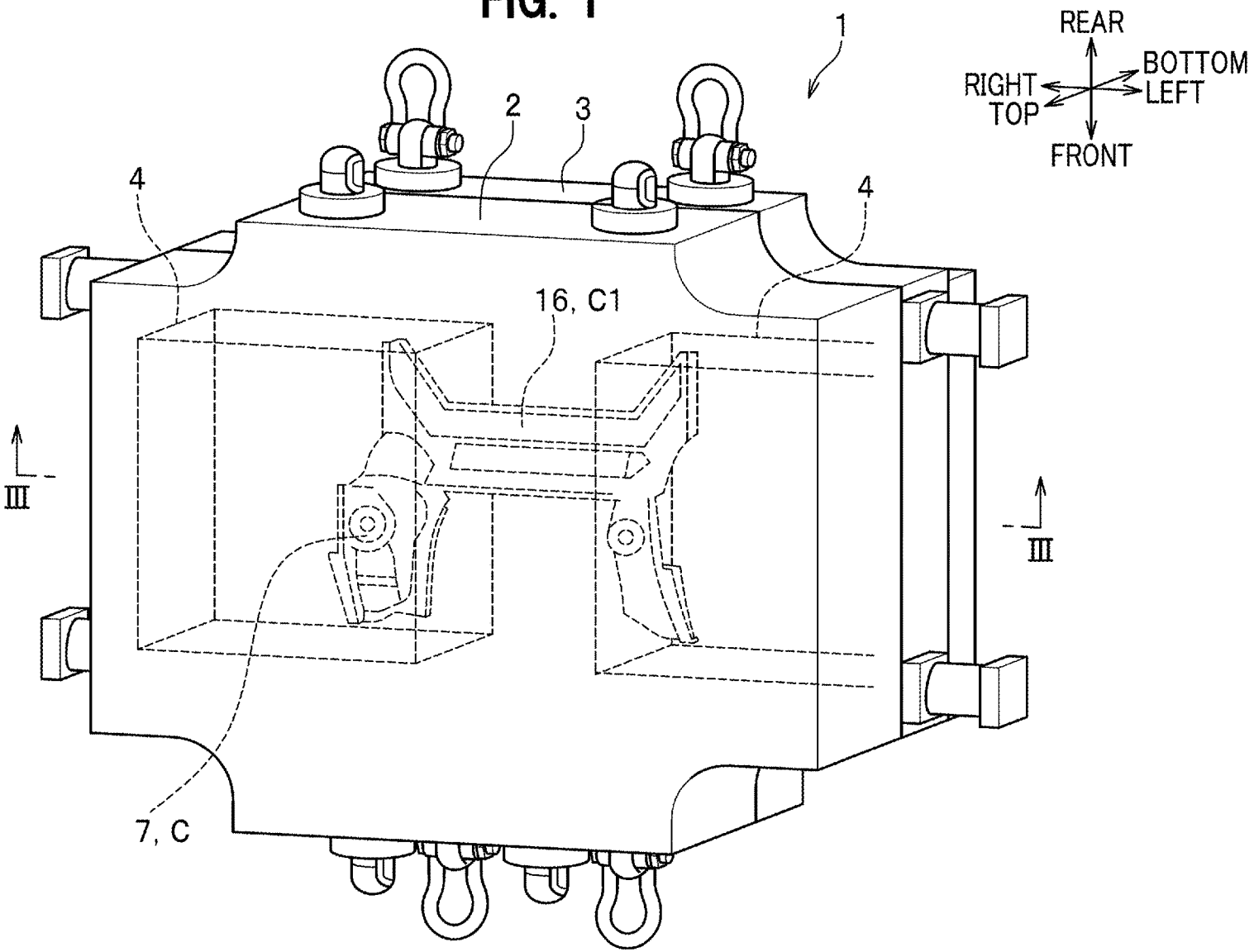
FIG. 1 is an entire perspective view of a casting die according to an embodiment of the present invention.

As shown in FIG. 1, a casting die 1 according to the present embodiment includes a stationary die 2, a movable die 3, and sliding dies 4. In FIG. 1, the sliding dies 4 placed between the stationary die 2 and the movable die 3 are schematically expressed by hidden lines (dotted lines) for convenience of drawing. In FIG. 1, the shapes of a cast product 7 and a cavity C for shaping the cast product 7 are also expressed by hidden lines.

The following description will be given by taking, as an example, the casting die 1 for casting a vehicle body structure by using a molten metal of recycled aluminum, but the cast product and the molten metal are not limited to these.

In the present embodiment, the shape of the cast product 7 obtained with the casting die 1 will be specifically described first, and then the casting die 1 and the casting method using the same will be described.

<<Cast Product>>

Figure 2:
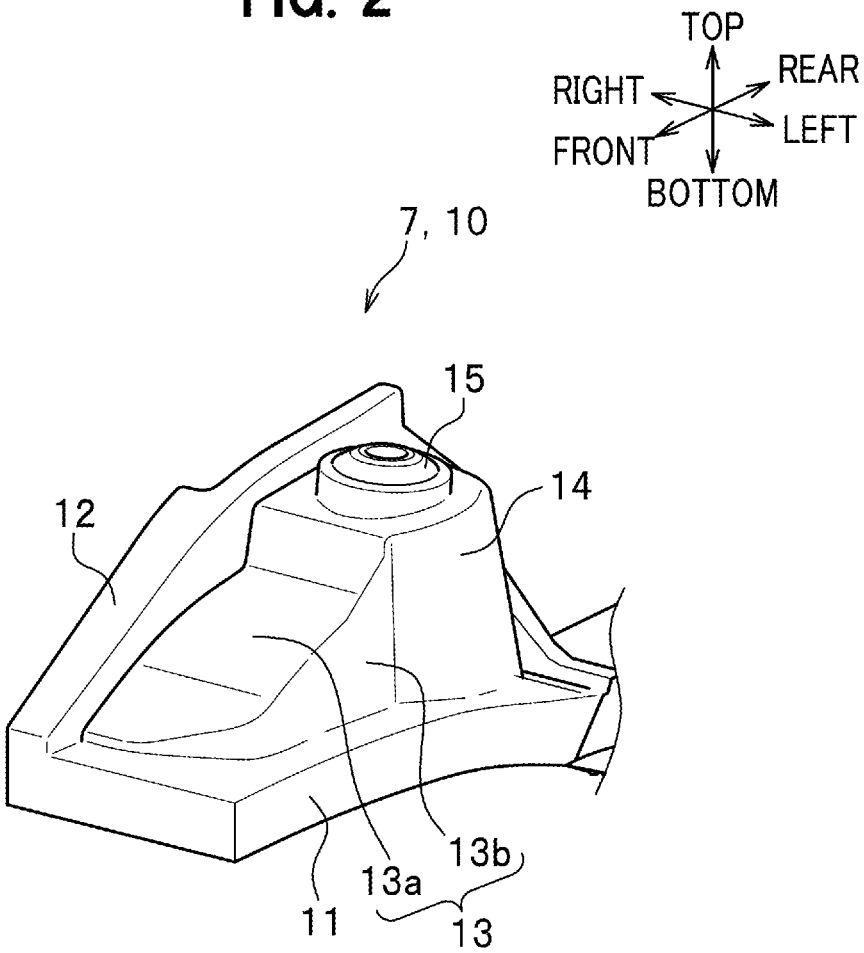
FIG. 2 is a partial enlarged perspective view of a cast product produced with the casting die in FIG. 1.

FIG. 2 is a partial enlarged perspective view of the cast product 7 produced with the casting die 1 in FIG. 1. The cast product 7 in FIG. 2 is a right side portion of the cast product 7 shown in FIG. 1.

As shown in FIG. 2, the cast product 7 as an example in the present embodiment is an integrally cast vehicle body structure 10, while a vehicle body structure has been conventionally formed of multiple members joined by welding or the like.

This vehicle body structure 10 in FIG. 2 mainly includes a side frame 11, an upper member 12, a wheel house 13, and a damper housing 14.

The side frame 11 is a long member extending in a vehicle front-rear direction on each of the right and left sides of a vehicle body front portion and a vehicle body rear portion.

The side frames 11 are coupled to a bumper beam extension (not shown), and the rear ends of the right and left side frames 11 are coupled to each other via a panel-shaped dashboard lower 16 (see FIG. 1) that faces in a top-bottom direction.

The upper member 12 is formed of a long member extending rearward outside the side frame 11 in a vehicle width direction while forming an upwardly-convex substantially circular arc.

The wheel house 13 is united with a wheel house outer half (not shown) to form a space for housing a tire wheel. In other words, the wheel house 13 of the vehicle body structure 10 shown in FIG. 2 is a wheel house inner half.

As shown in FIG. 2, the wheel house 13 is a three-dimensional structure formed of an arch-shaped panel. Specifically, the wheel house 13 includes an upper wall 13*a* extending in the front-rear direction while forming an upwardly-convex circular arc, and a side wall 13*b* extending from a vehicle-widthwise inner side of the upper wall 13*a* downward to be connected to the side frame 11.

A vehicle-widthwise outer side of the upper wall 13*a* is connected to the upper member 12. Then, a vehicle-widthwise outer side of the wheel house 13 has an opening shaped like a circular arc (not shown), and a back surface (lower surface) of the upper wall 13*a* of the wheel house 13 is formed along a sliding direction of the sliding die 4 (in the right-left direction in FIG. 2) so that the sliding die 4 to be described later (see FIG. 3) can be removed.

The damper housing 14 is formed such that the wheel house 13 partially protrudes upward. The damper housing 14 has an internal space common to the wheel house 13. Then, a vehicle-widthwise outer side of the damper housing 14 is opened together with the opening of the wheel house 13 so that the sliding die 4 to be described later (see FIG. 3) can be removed.

An upper edge of the vehicle-widthwise outer side of the damper housing 14 is connected to the upper member 12. A portion of the upper member 12 to be connected to the damper housing 14 has an L-shaped cross-sectional shape, although that is not shown. Then, a portion of the upper member 12 to be connected to the wheel house 13 has a U-shaped cross-sectional shape opened to the vehicle-widthwise outer side.

A damper base 15 to which a damper (not shown) is to be attached is formed on a top portion of the damper housing 14. Specifically, the damper base 15 is formed in a dome shape further expanding upward from the top portion of the damper housing 14.

The inside of the damper base 15 forms an internal space in a columnar shape so that a slider core 5 (see FIG. 5) to be described later can be removed.

<<Casting Die>>

The casting die 1 (see FIG. 1) in the present embodiment enables integral casting of the vehicle body structure 10 (see FIG. 2) having a large size and a complex structure as described above.

FIG. 1 shows the front vehicle body structure as one example, but the structure is not limited to the front structure but may be a rear structure. The present invention is not limited to a casting die for a vehicle body component, but may be applied to a casting die for any of various cast components having similar main structures.

The casting die 1 (see FIG. 1) has a structure designed to not only facilitate die release of undercuts of the cast product 7 (see FIG. 1), and but also improve the positional accuracy of each die.

Note that the front-rear, top-bottom, and right-left directions shown in FIG. 1 are just defined according to the front-rear, top-bottom, and right-left directions of the vehicle body structure 10 in FIG. 2 for convenience of description of the present embodiment, and the front-rear, top-bottom, and right-left directions of the casting die 1 are not limited to these.

As shown in FIG. 1, the casting die 1 includes the movable die 3 movable in the top-down direction so as to come into and out of contact with the stationary die 2, and the sliding dies 4 provided to the movable die 3 so as to be insertable and withdrawable in a direction crossing the movement direction (the top-bottom direction) of the movable die 3, that is, in the right-left direction in FIG. 1.

As shown in FIG. 1, a cavity C1 for casting the dashboard lower 16 is formed between the stationary die 2 and the movable die 3.

Figure 3:
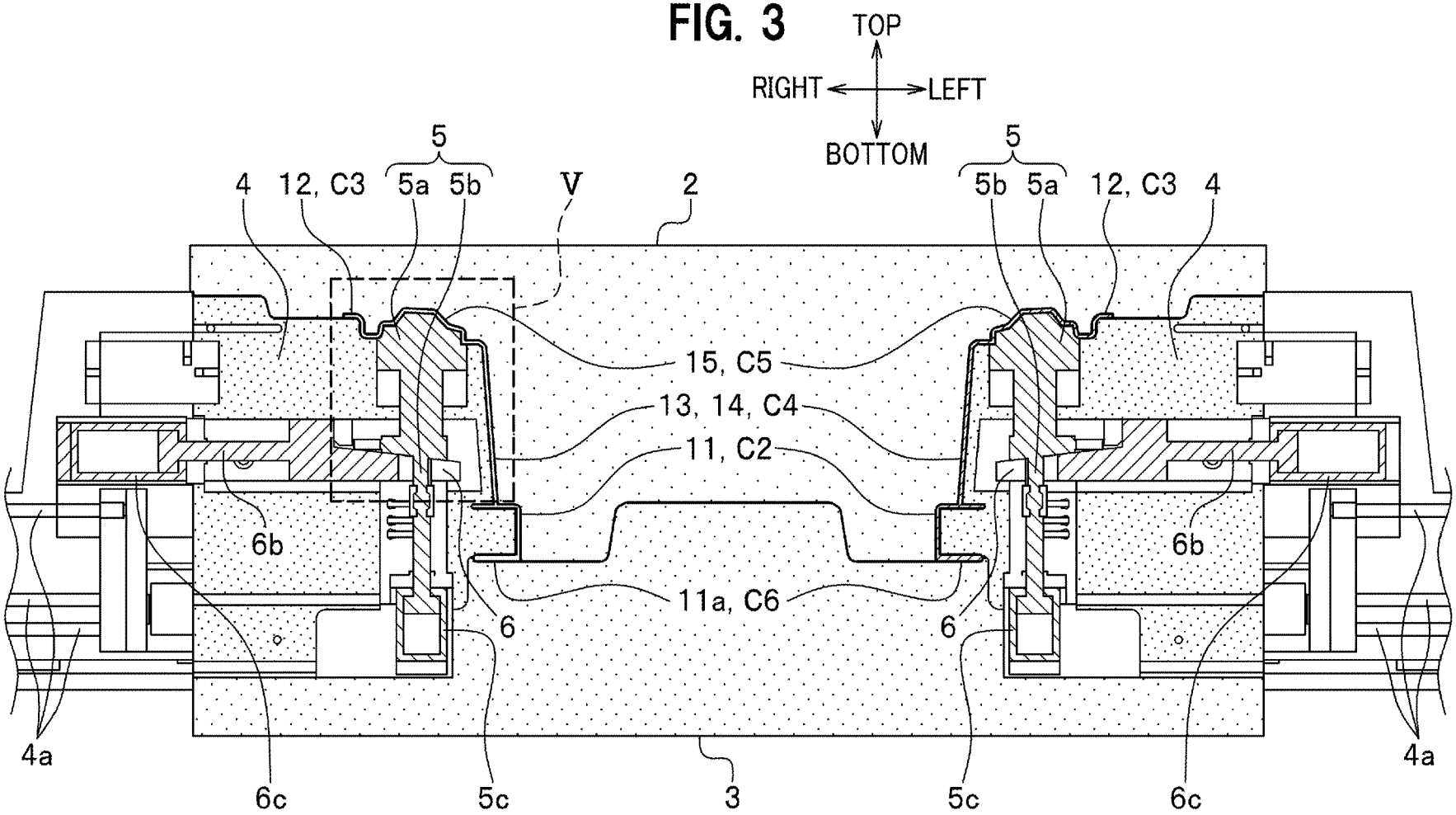
FIG. 3 is a cross-sectional view taken along III-III in FIG. 1.

As shown in FIG. 3, which is a cross-sectional view taken along III-III in FIG. 1, a cavity C2 for casting the side frame 11, a cavity C3 for casting the upper member 12, a cavity C4 for casting the wheel house 13 and the damper housing 14, and a cavity C5 for casting the damper base 15 are formed between the stationary die 2 and each sliding die 4.

In addition, as shown in FIG. 3, a cavity C6 for casting a lower wall 11*a* constituting a U-shaped cross section of the side frame 11 is formed between each sliding die 4 and the movable die 3.

The sliding dies 4 can be opened in the right-left direction from the movable die 3 separated from the stationary die 2. The sliding dies 4 are slid relative to the movable die 3 by driving rods 4*a* as shown in FIG. 3. Here, the driving rods 4*a* in the present embodiment are assumed to insert and withdraw the sliding dies 4 by using driving sources such as hydraulic cylinders.

Then, each sliding die 4 includes a slider core 5 and a stopper 6 for the slider core 5 as shown in FIG. 3.

Figure 4:
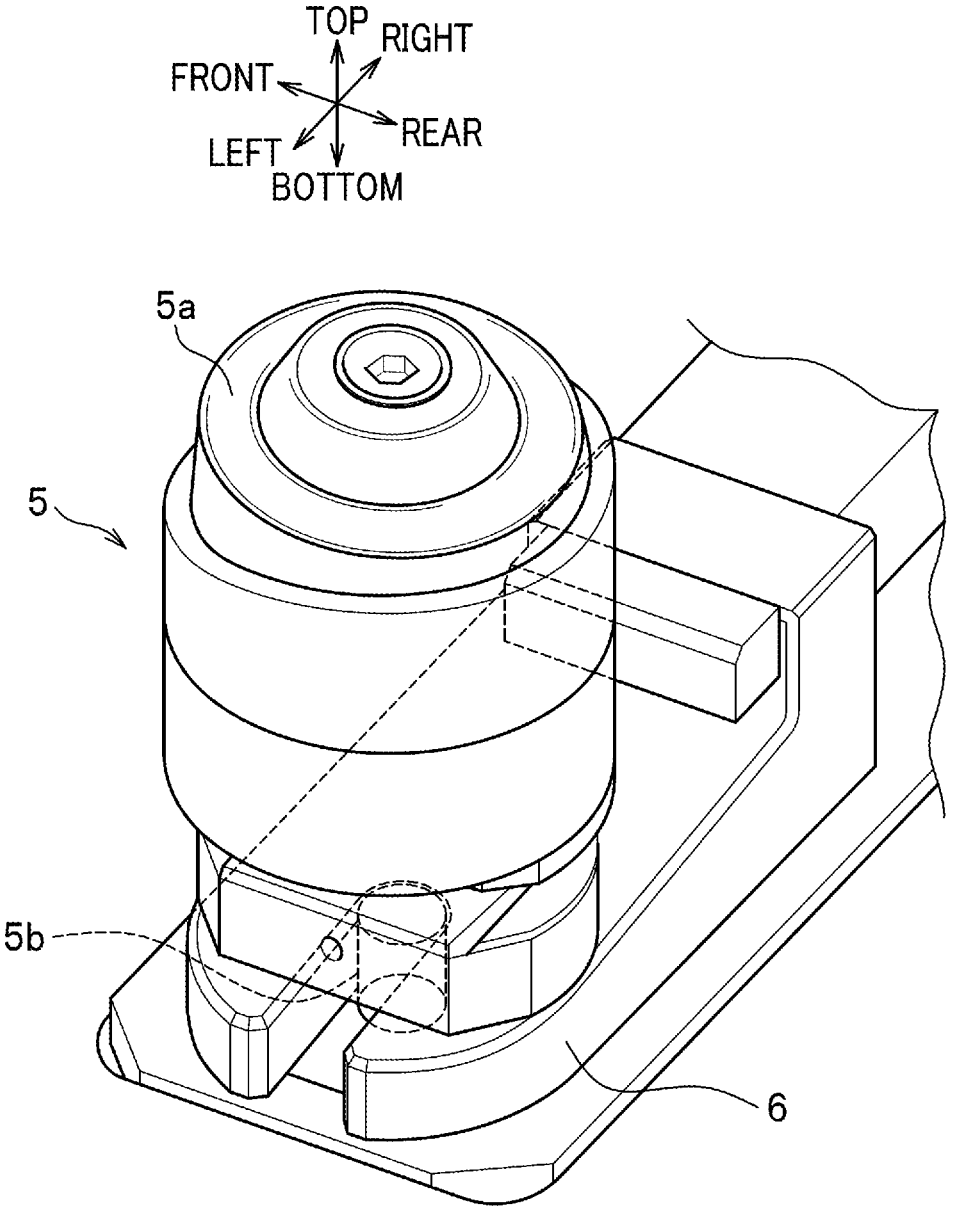
FIG. 4 is a partial enlarged perspective view illustrating a state where a slider core is locked with a stopper.

FIG. 4 is a partial enlarged perspective view illustrating a state where the slider core 5 is locked with the stopper 6

As shown in FIG. 4, the slider core 5 has a core body 5*a* in a substantially columnar shape.

The slider core 5 also has a rod 5*b* extending from a bottom surface of the core body 5*a* downward.

The slider core 5 also has a hydraulic cylinder 5*c* connected to a bottom edge of the rod 5*b* as shown in FIG. 3. This hydraulic cylinder 5*c* corresponds to a "first moving mechanism" defined in claims.

Figure 5:
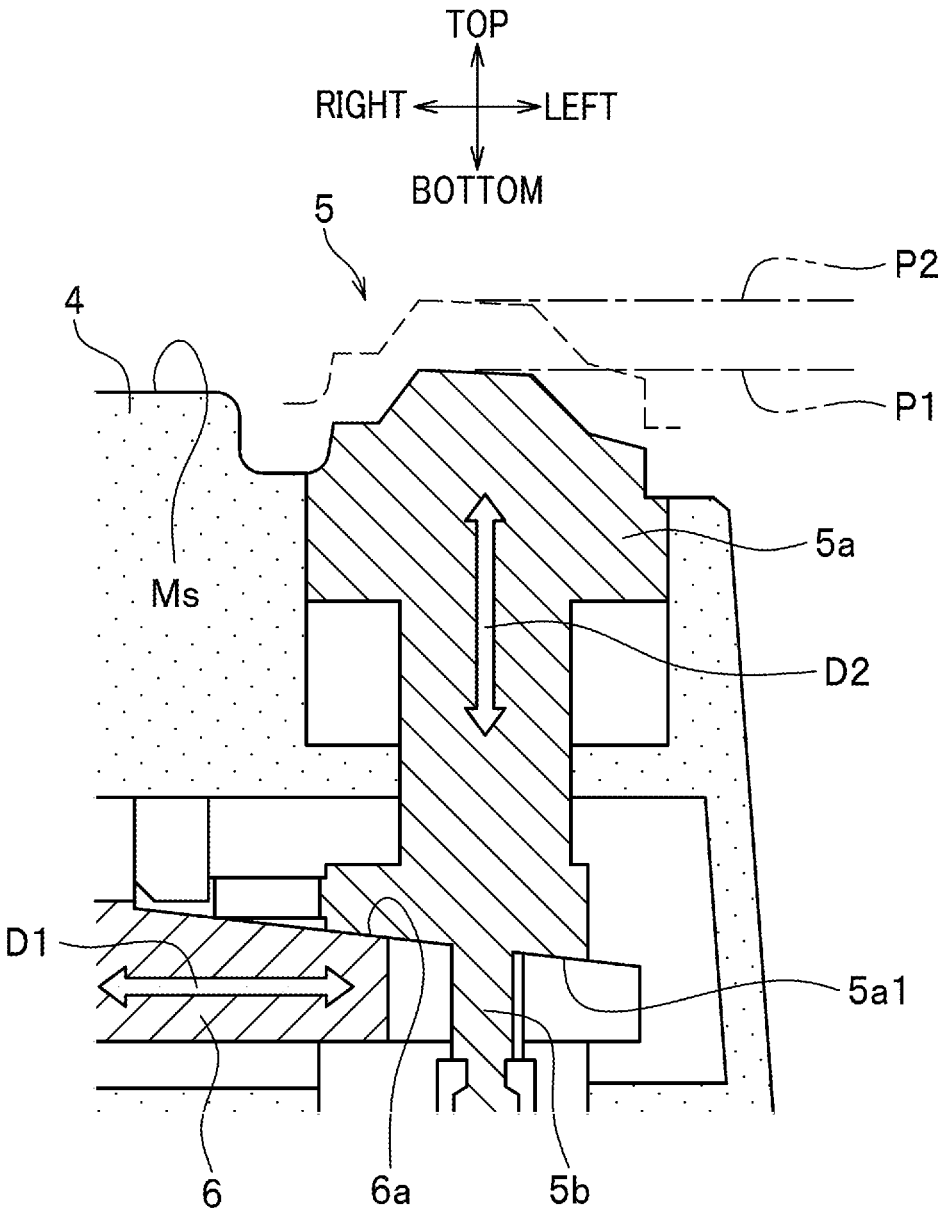
FIG. 5 is a partial enlarged perspective view of a portion V in FIG. 3.

The hydraulic cylinder 5*c* shown in FIG. 3 moves the core body 5*a* via the rod 5*b* so as to be insertable and withdrawable in the top-bottom direction (the movement direction of the movable die 3 (see FIG. 3)), as shown in FIG. 5, which is a partial enlarged view of a V portion in FIG. 3. Thus, the core body 5*a* is pulled into the sliding die 4 so that a tip of the core body 5*a* retracts from a cavity forming surface Ms of the sliding die 4 shown in FIG. 5, or is pushed out of the sliding die 4 so that the tip produces from the cavity forming surface Ms.

Then, as shown in FIG. 5, when the tip of the core body 5*a* is set at a casting position P1, the core body 5*a* forms the cavity C4 (see FIG. 3) for casting the damper base 15 in collaboration with the stationary die 2 (see FIG. 3).

Moreover, as shown in FIG. 5, the core body 5*a* in the present embodiment is movable up to a limit position P2 protruding from the casting position P1 (hereinafter referred to as the protrusion limit position P2)) in a preliminary pushing step S108 (see FIG. 6) in the casting method to be described later.

As shown in FIG. 3, the stopper 6 is coupled to a hydraulic cylinder 6*c* via a rod 6*b*. The hydraulic cylinder 6*c* corresponds to a "second moving mechanism" defined in claims.

The stopper 6 locks the slider core 5 by coming into contact with a bottom surface 5*al* of the core body 5*a* as shown in FIG. 5.

Specifically, the stopper 6 is placed at a locking position at which the tip of the core body 5*a* is positioned at the casting position P1.

Moreover, the stopper 6 can come into and out of contact with the slider core 5 by being moved by the hydraulic cylinder 6*c* in the right-left direction as shown in FIG. 3. In other words, when the stopper 6 is separated from the slider core 5, the stopper 6 is placed at an unlocking position at which the stopper 6 unlocks the slider core 5.

In addition, as shown in FIG. 5, a top surface 6*a* of the stopper 6 to be in contact with the bottom surface 5*al* of the core body 5*a* is inclined with respect to a movement direction D1 of the stopper 6. Specifically, the top surface 6*a* of the stopper 6 is inclined so as to extend downward toward the tip of the stopper 6.

Thus, as shown in FIG. 5, as the stopper 6 is moved in the movement direction D1 of the stopper 6, the slider core 5 is accordingly moved in a movement direction D2 while the bottom surface 5*al* of the core body 5*a* slides on the top surface 6*a*.

In other words, with adjustment of the position of the stopper 6 in the movement direction D1, the stopper 6 is capable of positioning and locking the tip of the core body 5*a* at the casting position P1.

Although the contact surface of the stopper 6 with the bottom surface 5*al* of the core body 5*a* (the top surface 6*a* of the stopper 6) is inclined in the present embodiment, the bottom surface 5*al* of the core body 5*a* may be also inclined with respect to the movement direction D1 of the stopper 6.

That is, any structure may be used as long as the slider core 5 is moved in the movement direction D2 as the stopper 6 is moved in the movement direction D1.

Therefore, only at least one of the top surface 6*a* of the stopper 6 and the bottom surface 5*al* of the core body 5*a* has to be inclined with respect to the movement direction D1 of the stopper 6.

In addition, as shown in FIG. 4, the stopper 6 has bifurcate tips.

Then, the stopper 6 at the locking position is located to put the rod 5*b* of the slider core 5 in contact with the inner sides of the bifurcate tips as shown in FIG. 4, and is put in contact with the bottom surface 5*a*1 of the core body 5*a* as shown in FIG. 5.

<<Casting Method>>

Next, the casting method using the casting die 1 will be described mainly in reference to FIGS. 3 and 5.

The casting method in the present embodiment includes: [1] a moving step of moving the stopper 6 to the core body 5*a* of the slider core 5; [2] a locking step of positioning and locking the core body 5*a* by adjusting the position of the stopper 6 so that the tip of the core body 5*a* forms the cavity C5; [3] an applying step of spraying and applying a die release agent to the surface of the stationary die 2, the surface of the movable die 3, the surfaces of the sliding dies 4, and the surfaces of the core bodies 5*a*, which will form the cavity C (see FIG. 1); [4] a die closing step of closing the sliding dies 4 onto the movable die 3; [5] a die closing step of closing the movable die 3 onto the stationary die 2; [6] a step of injecting and filling a molten metal of recycled aluminum into the cavity C (see FIG. 1) under high pressure; and [7] a step of forming the cast product 7 formed of the recycled aluminum in the cavity C (see FIG. 1).

In addition, the casting method in the present embodiment includes: [8] a die opening step of separating the movable die 3 united with the sliding dies 4 from the stationary die 2; [9] a preliminary pushing step of pushing the core body 5*a* at the casting position P1 (see FIG. 5) toward the cavity C (toward the stationary die 2) once, and then returning the core body 5*a* to the casting position P1 (see FIG. 5) again; [10] an unlocking step of setting the stopper 6 at the unlocking position after the preliminary pushing step; [11] a core pull-in step of pulling the core bodies 5*a* into the sliding dies 4; [12] a sliding die opening step of opening the sliding dies 4 from the movable die 3 after the core pull-in step; and [13] a step of taking out the cast product 7.

The casting method in the present embodiment produces cast products 7 (see FIG. 1) sequentially by repeating the foregoing steps [1] to [13] as one cycle.

Figure 6:
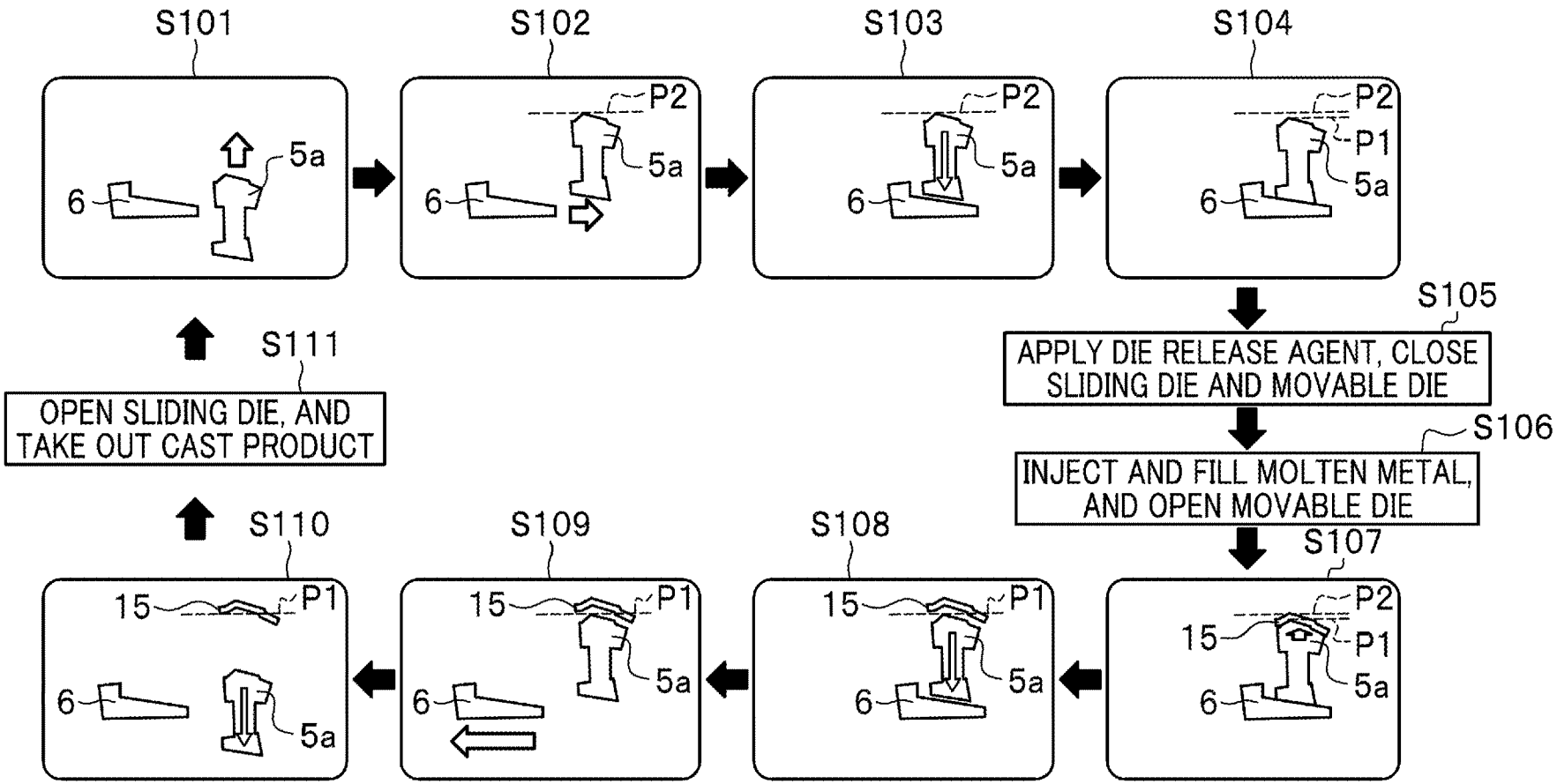
FIG. 6 is an explanatory diagram for steps in a casting cycle in a casting method according to the embodiment of the present invention.

FIG. 6 is an explanatory diagram for steps in a casting cycle in the casting method. In FIG. 6, reference sign 5*a* indicates the core body of the slider core 5 (see FIG. 3), reference sign 6 indicates the stopper, and reference sign 15 indicates the damper base, which is a portion of the cast product 7 (see FIG. 2). Reference sign P1 indicates the casting position of the core body 5*a* and reference sign P2 indicates the protrusion limit position of the core body 5*a*.

As shown in FIG. 6, in the casting method in the present embodiment, [1] the moving step is first performed.

In this step, as shown in step S101, the core body 5*a* is first pushed up by the hydraulic cylinder 5*c* (see FIG. 3). The initial position of the core body 5*a* before the pushing-up is the position after [11] the core pull-in step.

Then, as shown in step S102, in the state where the core body 5*a* is pushed up to the protrusion limit position P2, the stopper 6 is moved toward the core body 5*a* by the hydraulic cylinder 6*c* (see FIG. 3).

Next, as shown in step S103, the core body 5*a* is lowered in the state where the stopper 6 is located under the core body 5*a*. In this step, the position of the stopper 6 relative to the core body 5*a* is set to the above locking position. Here, the core body 5*a* is assumed to be lowered by the hydraulic cylinder 5*c* (see FIG. 3), but the core body 5*a* may be lowered by its own weight.

Then, as shown in step S104, [2] the locking step is completed in the state where the core body 5*a* at the casting position P1 is in contact with the stopper 6.

Subsequently, in this casting method, as shown in step S105, [3] the die release agent applying step, [4] the die closing step of the sliding dies 4, and [5] the die closing step of the movable die 3 are performed. As a result, the cavity C (see FIG. 1) for pouring the molten metal is formed. After that, as shown in step S106, [6] the step of injecting and filling the molten metal into the cavity C under high pressure and [7] the step of forming the damper base 15 (cast product) are performed. Then, in order to take out the cast product 7 (see FIG. 1) from the die, the die opening step of the movable die 3 united with the sliding dies 4 is first performed. Although not shown, the damper base 15 (the portion of the cast product 7 (see FIG. 1)) formed on the top surface of the slider core 5 (the core body 5*a*) in the sliding die 4 is separated from the stationary die 2 (see FIG. 3). In [8] the die opening step, a space is secured above the damper base 15 so that the core body 5*a* can be pushed out in the following preliminary pushing step.

In [9] the preliminary pushing step, the core body 5*a* is pushed up from the casting position P1 to the protrusion limit position P2 by the hydraulic cylinder 5*c* (see FIG. 3) as shown in step S107. Next, as shown in step S108, the core body 5*a* is pulled down from the protrusion limit position P2 to the casting position P1 by the hydraulic cylinder 5*c* (see FIG. 3).

As a result, in [9] the preliminary pushing step, the damper base 15 (cast product) on the core body 5*a* is separated from the core body 5*a* with slight elastic deformation. A clearance is formed between the core body 5*a* and the damper base 15.

In [10] the unlocking step, as shown in step S109, the stopper 6 is moved away from the core body 5*a* and set at the unlocking position by the hydraulic cylinder 6*c* (see FIG. 3).

Subsequently, in [11] the core pull-in step, as shown in step S110, the core body 5*a* is pulled into the sliding die 4 by the hydraulic cylinder 5*c* (see FIG. 3).

After that, as shown in S111, [12] the sliding die opening step and [13] the step of taking out the cast product 7 (see FIG. 1) are preformed, and thus one cycle of the casting method in the present embodiment is completed. Then, this casting cycle is repeated to produce the cast products 7 (see FIG. 1) sequentially as describe above.

<<Effects>>

Next, effects produced by the casting die 1 and the casting method according to the present embodiment will be described.

The casting die 1 in the present embodiment includes the sliding dies 4 constituting the portions of the cavity C, and each sliding die 4 includes the slider core 5 and the hydraulic cylinder 5*c* as the mechanism of moving the slider core 5.

In the casting die 1 as described above, the maintenance of the slider core 5 can be easily carried out by taking out only the sliding die 4 from the main die, namely, the movable die 3, unlike a casting die in the related art (for example, see JP1991-9885Y). The casting die 1 enables reductions in person-hours and the work time for the maintenance.

According to the casting die 1 as described above, the simple structure is capable of positioning the dies for forming the cavity with higher accuracy than in the case of a casting die in the related art which requires a first movable core and a second movable core to be engaged with each other and positioned with high accuracy. As a result, the casting die 1 can prevent the molten metal from being inserted between the dies even when the molten metal is injected under high pressure. In addition, the casting die 1 can reduce the influence of thermal expansion of the slider core 5. With the casting die 1, it is possible to improve the shaping accuracy of the cast product 7.

Moreover, in the casting die 1, the sliding die 4 includes the stopper 6 for locking the slider core 5 and the hydraulic cylinder 6*c* as the mechanism of moving the stopper 6.

According to the casting die 1 as described above, the freedom in design can be enhanced as compared with a casting die in the related art which requires a first movable core and a second movable core to be engaged with each other and positioned with high accuracy.

In addition, in the casting die 1 as described above, the stopper 6 at the locking position is located to put the rod 5*b* of the slider core 5 in contact with the inner sides of the bifurcate tips and is put in contact with the bottom surface 5*a*1 of the core body 5*a*.

With the casting die 1 as described above, the rod 5*b* of the slider core 5 is held from at least two directions, so that the stopper 6 can effectively lock the slider core 5 by preventing the slider core 5 from rattling.

Further, in the casting die 1 as described above, the bottom surface 5*a*1 of the core body 5*a* is positioned by the top surface 6*a* of the stopper 6.

The casting die 1 as described above can more reliably prevent the slider core 5 from displacing and tilting because the pressure of the molten metal applied to the slider core 5 is received by the surface. As a result, the casting die 1 can more reliably prevent the molten metal from being inserted between the dies. In the casting die 1, it is possible to prevent wear of peripheral components of the slider core 5 and even more increase its service life.

In the casting die 1 as described above, the contact surface of the stopper 6 with the bottom surface 5*a*1 of the core body 5*a* is inclined with respect to the movement direction D1 of the stopper 6.

According to the casting die 1 as described above, the sliding resistance between the stopper 6 and the bottom surface 5*a*1 of the core body 5*a* during the movement of the stopper 6 can be kept low. According to the casting die 1 as described above, the slider core 5 can be prevented from galling against the stopper 6 due to the molten metal pressure that the slider core 5 receives during casting. As a result, the casting die 1 makes it possible to more reliably prevent the slider core 5 from malfunctioning.

The casting method using the casting die 1 in the present embodiment includes the step of moving the stopper 6 and the step of locking the slider core 5 by the stopper 6.

According to the casting method as described above, it is possible to prevent the slider core 5 from displacing and thereby more reliably prevent the molten metal from inserting during casting.

In addition, after the cast product 7 is formed in the cavity C, this casting method includes the preliminary pushing step of pushing out the slider core 5 from the casting position and the core pull-in step of pulling back the slider core 5 into the sliding die 4.

According to the casting method as described above, the core pull-in step makes it possible to release the sliding dies 4 from the movable die 3.

Moreover, in this casting method, the damper base 15, which is the portion of the cast product 7, is slightly elastically deformed in the preliminary pushing step, so that a clearance can be formed between the slider core 5 (the core body 5*a*) and the damper base 15. As a result, the damper base 15 can be more easily released from the slider core 5.

Further, in this casting method, a casting pressure applied during the casting is applied to the stopper 6 after the casting via the bottom surface 5*a*1 of the slider core 5 (the core body 5*a*). In other words, the top surface 6*a* of the stopper 6 is strongly pressed against the bottom surface 5*a*1 of the core body 5*a* shown in FIG. 5.

Meanwhile, in the casting method in the present embodiment, the load applied to the stopper 6 due to the casting pressure is released in the preliminary pushing step. Thus, in the casting method, the locking of the slider core 5 with the stopper 6 can be easily released. Furthermore, according to the casting method, since the stopper 6 can easily come off the slider core 5, it is possible to reliably prevent a failure of die release and deformation of the cast product 7.

According to the casting die 1 as described above and the casting method using this casting die 1, a cast product 7 is prevented from deforming or cracking in the course of die release, so that the cast product 7 with high shaping accuracy can be obtained, and such stable die release makes it possible to improve the maintainability and reduce the cycle time.

Although the present embodiment is described above, the present invention is not limited to the above embodiment, but may be carried out in various embodiments.

What is claimed is:

1. A casting die comprising:

a stationary die;

a movable die that is moved to come into and out of contact with the stationary die; and a sliding die provided to the movable die so as to be insertable and withdrawable in a direction crossing a movement direction of the movable die and configured to form a cavity in collaboration with the stationary die and the movable die, wherein the sliding die includes:

slider core that is moved by a first moving mechanism so as to be insertable and withdrawable along the movement direction of the movable die; and a stopper that is moved by a second moving mechanism between a locking position at which the stopper is in contact with the slider core at a die closing position and locks the slider core, and an unlocking position at which the stopper is separated from the slider core and unlocks the slider core.

2. The casting die according to claim 1, wherein the slider core includes a rod extending from a bottom surface of a core body of the slider core and connecting to the first moving mechanism, the stopper has a bifurcate shape, and the stopper locks the slider core by putting the rod of the slider core in contact with an inner side of the bifurcate shape, and coming into contact with the bottom surface of the core body.

3. The casting die according to claim 2, wherein a contact surface of the stopper with the bottom surface of the core body is inclined with respect to a movement direction of the stopper moved by the second moving mechanism.

4. A casting method using a casting die, the casting die including:

a stationary die;

a movable die that is moved to come into and out of contact with the stationary die; and a sliding die provided to the movable die so as to be insertable and withdrawable in a direction crossing a movement direction of the movable die and configured to form a cavity in collaboration with the stationary die and the movable die, the sliding die including:

a slider core that is moved so as to be insertable and withdrawable along the movement direction of the movable die; and a stopper that comes into contact with the slider core at a die closing position and locks the slider core, the method comprising:

a moving step of moving the stopper to the slider core;

a locking step of positioning and locking the slider core by adjusting a position of the stopper so that a tip of the slider core forms the cavity;

a die release agent applying step of applying a die release agent to at least a surface of the stationary die, a surface of the movable die, and a surface of the sliding die, which form the cavity; and a die closing step of placing the sliding die at a sliding die clamping position, and closing the movable die onto the stationary die.

5. The casting method according to claim 4, further comprising:

a preliminary pushing step of pushing the slider core at a casting position toward the cavity once and then returning the slider core to the casting position again, after steps of forming a cast product in the cavity and separating the movable die from the stationary die;

an unlocking step of setting the stopper at an unlocking position after the preliminary pushing step;

a core pull-in step of pulling back the slider core into the sliding die;

a sliding die opening step of opening the sliding die from the movable die after the core pull-in step; and a step of taking out the cast product.

* * * * *